US008844509B2

(12) United States Patent
Howard

(10) Patent No.: US 8,844,509 B2
(45) Date of Patent: Sep. 30, 2014

(54) CAM BLADE

(76) Inventor: Robert Scott Howard, Jacksonville, FL (US)

( * ) Notice: Subject to any disclaimer, the term of this patent is extended or adjusted under 35 U.S.C. 154(b) by 105 days.

(21) Appl. No.: 13/507,767

(22) Filed: Jul. 27, 2012

(65) Prior Publication Data

US 2014/0026875 A1 Jan. 30, 2014

(51) Int. Cl.
*F41B 5/10* (2006.01)

(52) U.S. Cl.
USPC ..... 124/25.6; 124/900

(58) Field of Classification Search
USPC ..... 124/23.1, 25.6, 86, 900
See application file for complete search history.

(56) References Cited

U.S. PATENT DOCUMENTS

| | | | | | |
|---|---|---|---|---|---|
| 2,968,300 | A * | 1/1961 | Allen | 124/23.1 |
| 4,360,179 | A * | 11/1982 | Roberts | 248/126 |
| 4,714,070 | A * | 12/1987 | Shelton | 124/86 |
| 4,979,488 | A | 12/1990 | Fenton et al. | |
| 6,216,680 | B1 * | 4/2001 | Sanders | 124/86 |
| D530,387 | S * | 10/2006 | Kennedy | D22/107 |
| 7,730,883 | B2 | 6/2010 | Lawson et al. | |
| 2009/0272369 | A1 * | 11/2009 | Konczal | 124/25.6 |

* cited by examiner

*Primary Examiner* — John Ricci

(57) ABSTRACT

The apparatus disclosed begins exterior of archery bow stave cam slot and traverses a generally elliptically ovidly path convexed and roughly shaped paralleling exterior perimeter edge movement of an elliptically ovid cam module, and a portion of the apparatus is formed to terminate at a point on cam module that is appropriate to provide damage and abrasive protection to cam module and power and buss cable without interference of the aforementioned. Said apparatus is shaped cross sectionally in a manner that is small, light weight and does not interfere with the normal operation of an archery bow.

5 Claims, 4 Drawing Sheets

CAM BLADE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

This invention relates generally to the U.S. Patent classification definitions technical field of but not limited to; Class 273 Archery/Subclass 317+ and Class 124 Mechanical guns and projectors/subclass 23.1 bow, subclass 25 crossbow, subclass 25.6 compound bow, and more specifically to a unique and novel apparatus that provides protection to such as but not limited to, an archery bow's cam module, idler module, tension cable and string, stave reel, wheel etc. which are mounted at or near the extreme end of a bow stave from contact with objects which would cause damage to the aforementioned.

2. Prior Art

Archery in its purest form has long been associated with the Native American bow and arrow, and while the newest style of bow is the compound bow, it was invented in the mid-20th century with $20^{th}$ century technology. Said compound bow consisted of steel pulleys and/or cams on the ends of the staves, with a long string that criss-crosses the bow multiple times. One limb usually has an elliptical cam, which produces a sudden reduction in the draw weight of the bow when a certain point is reached. Another form had double elliptical cams but had timing problems. Bow material was commonly wood or fiberglass. Computer software had yet to be invented that could demonstrate stress and g-force generated upon staves, strings and elliptical pulleys. Arrow speed was comparably slow at 200 fps and archery bows had a typical "C" shape. Typically archery bows described can be bought in expensively.

In the $21^{st}$ century, computers and software technology have advanced archery as archery equipment has seen dramatic advances in aluminum and magnesium composite limb systems, parallel limb design, limb turrets, cam module, idler module, carbon tension cable and strings, power and buss cables, cable and string suppressors, inertia tungsten carbide weight disks embedded into cams and string grubs. The aforementioned advances and innovations have brought the modern compound bow to where it is today. Arrow speeds now reach 340 fps; computerized numerical controlled machines bend, form or vacuum composite material into variations of rectangular shapes with beyond parallel dual limbs tipped with cam modules, idler modules, string suppressors etc.

While archery equipment and compound bow performance advances have continued to rise, so has the price of this $21^{st}$ century technology. High performance archery bows cost upwards of $1,200. While there do exist many fanciful apparatus that will attach in all manners to an archers bow, they all have similar shortcomings which is none would provide adequate protection to said new and expensive $21^{st}$ century archery technology. Specifically the cam module and idler module elliptically ovidly shaped cams and associated power and buss cable's contact point on the take-up track of the cam without interfering with the aforementioned module(s) movement or sacrificing somewhere else.

For example, U.S. Pat. No. 7,730,883 discloses a bow cam protector that overlaps the cam with members extending beyond the cam. . . . While such a configuration may be suitable for providing limited cam protection, vibration dampening and a stand, the invention of the '883 patent does not provide protection to either said cam module and idler module elliptically ovidly shaped cams or associated power and buss cable's contact point on the take-up track of the cam. Also '883's said members extending beyond the cam could act as an undesirable hook while walking through thick forest while hunting.

U.S. Pat. No. 4,979,488 discloses a cam or eccentric wheel shield that quiets the sound of . . . and shields the movement of cams or a-centric wheels during movement and protects the wheels and the cable from becoming clogged, chipped or damaged. Disclosure of '488 is unique to $20^{th}$ century archery equipment but does not address the use of or the acceptance of $21^{st}$ century archery technology such as offset cam modules, idler module, string and cable suppressors or grubs. So also, said patent '488 is unlikely to withstand the g-force vibrations and recoil associated with $21^{st}$ century high performance archery bows. In addition, '488 interferes and blocks the mounting points for some string suppressors which are sold as stock equipment; and '488 interferes with cam module and idle module field adjustments.

Accordingly, a need remains for CAM BLADE in order to overcome the above-noted shortcomings. The non-limiting exemplary embodiments satisfies such a need by providing an apparatus that is convenient and easy to use, lightweight yet durable in design, versatile in its applications, and designed for easily and conveniently protecting cam module and idler module elliptically ovidly shaped cams and associated power and buss cable's contact point on the take-up track of the cam.

BRIEF SUMMARY OF THE INVENTION

In view of the foregoing background, it is therefore an object of the non-limiting exemplary embodiments to provide a brief summary of the invention and some of the advantages such as provides protection to: an archery bow's cam module, to the idler module, tension cable and string; provides protection to stave reel, cam, wheel etc. which are mounted at or near the extreme end of a bow stave. Another advantage is protection from contact with objects which would cause damage to the associated power and buss cable's contact point on the take-up track of the cam.

Described in one embodiment, CAM BLADE withstands g-shock from falling bow and describes material.

CAM BLADE position is detailed in another embodiment.

Described in one embodiment is the sweeping elliptically ovid shape.

In still another embodiment, CAM BLADE attachment by such as but not limited to, a threaded fastener through cam module.

Also an embodiment describes how CAM BLADE can be used on varying width, height and style of spokes within an archer's cam.

This invention CAM BLADE does not interfere with field adjustments to either the cam module.

These and other objects, features, and advantages of the invention are provided by description of the preferred embodiments.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
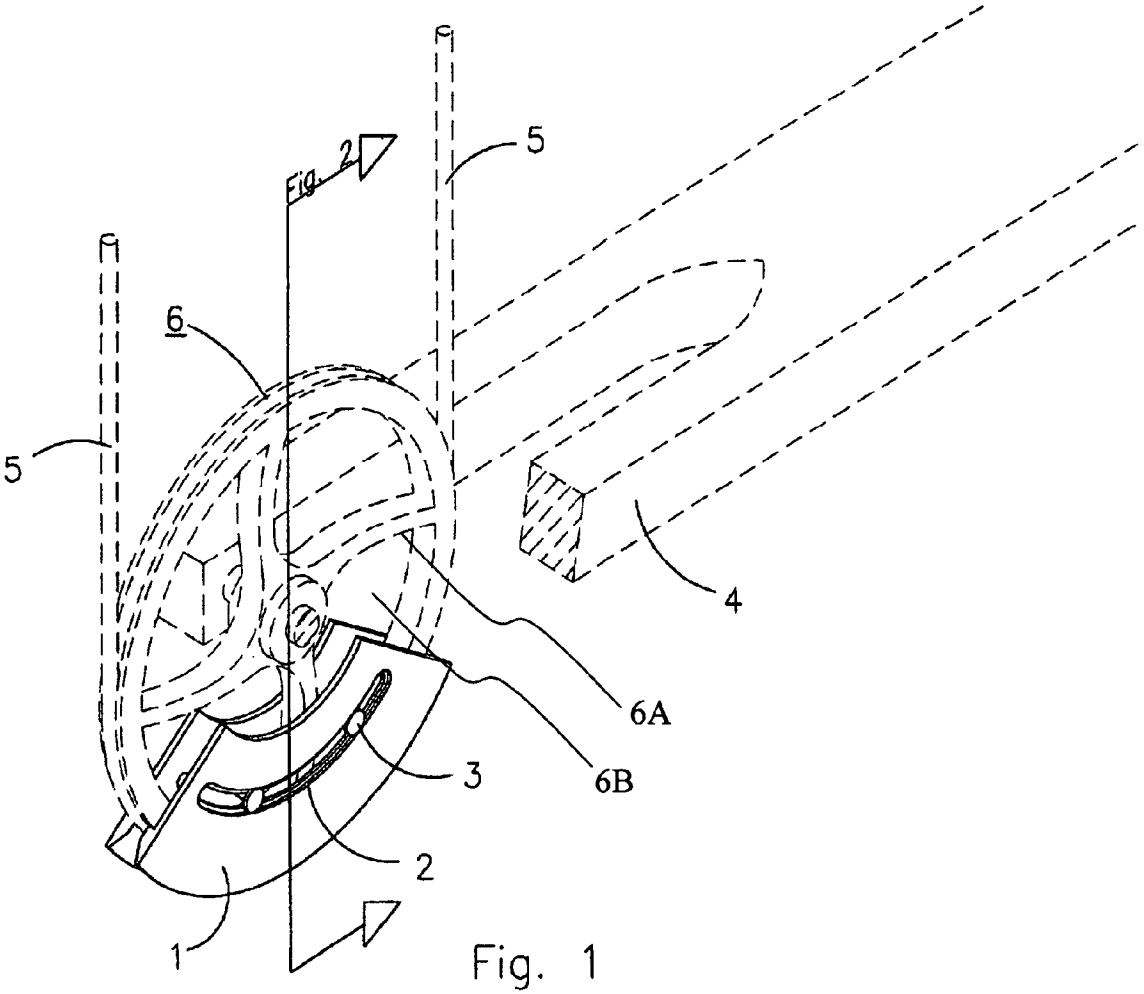
FIG. 1 is a perspective view showing CAM BLADE, in a preferred use installed on a compound bow's elliptically ovid shape cam module and in accordance with the non-limiting exemplary embodiments.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The non-limiting exemplary embodiments will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "non-limiting exemplary embodiments" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the non-limiting exemplary embodiments. Thus, to the maximum extent allowed by law, the scope of the non-limiting exemplary embodiments is to be determined by the broadest permissible interpretation of the following claims and their equivalents, and shall not be restricted or limited by the foregoing detailed description.

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "non-limiting exemplary embodiment" in various places in the specification are not necessarily all meant to refer to the same embodiment.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

The apparatus of this invention is referred to generally in FIGS. 1/4 and is intended to provide a perspective view showing CAM BLADE attached to a common 21$^{st}$ century high performance compound bow's elliptically ovid cam module. It should be understood that the non-limiting exemplary embodiments may be used to describe similar apparatus and many different types of devices that could be protected by CAM BLADE and should not be limited to the uses described herein. The descriptor nomenclature legend that follows is not meant to be all encompassing but to aid the reader in understanding the figures within the drawings.

Item Number 1: Cam Blade;
Item Number 2: T-Slot;
Item Number 3: T-Slot Fastener;
Item Number 4: Bow Stave;
Item Number 5: Power and buss cable;
Item Number: 6: Cam module, which is connected to its axis of rotation via radial support(s) 6A (such as spokes) with opening(s) 6B in or between said radial support(s) 6A;
Item Number 7: Fastener;
Item Number 8: Cam Blade Lip;

Viewing FIGS. 1/4, a perspective view, CAM BLADE is shown with descriptors numbered 1 thru 6 illustrating a first embodiment of the invention. CAM BLADE is constructed of a ridged lightweight material that withstands shock g-force delivered from a dropped archery compound bow and said material has a composition that minimizes abrasions. The 1 Cam Blade is situated symmetrically about and parallel to 6 cam module and/or respectively to the idler module (mirrored and not shown), and sandwiches said 6 cam module or idler module at the outer most point where said cam or idler module would naturally receive damage.

A further embodiment also viewed on FIGS. 1/4, is the angel in which said 1 cam blade is positioned. Said 1 cam blade begins at or near the underside of 4 bow stave and sweeps away from said 4 bow stave to a point on 6 cam module that is appropriate to provide damage and abrasive protection to 6 Cam module and 5 Power and buss cable.

An additional embodiment viewed on FIGS. 1/4, 1 cam blade is shaped in an elliptical ovid shape paralleling the 6 cam module and does not interfere with field adjustments to said 6 cam module.

Figure 2:
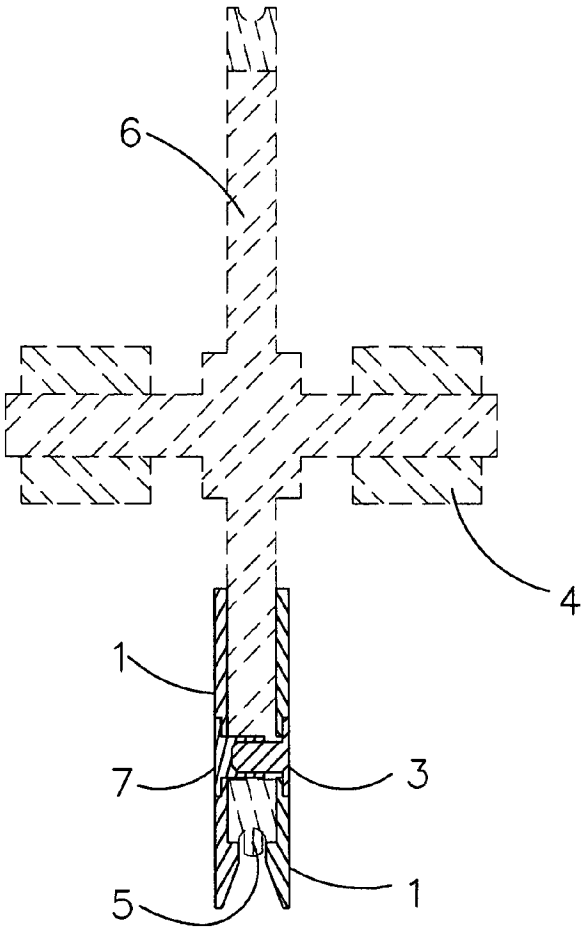
FIG. 2 is a cross-sectional end view showing CAM BLADE installed on a compound bow's elliptically ovid shape cam module.

Viewing FIG. 2, cross-sectional view, the reader can see a cross section of 1 cam blade, said 1 Cam Blade contains at least one 2 T-slot which 3 T-Slot fastener is inserted into and tightened against opposing 7 fastener sandwiching 6 cam module.

Also in FIG. 2, the reader can view 3 T-slot fastener and 7 fastener rest against the underside of 6 cam module thus restricting outward movement of said 1 cam blade.

Figure 3:
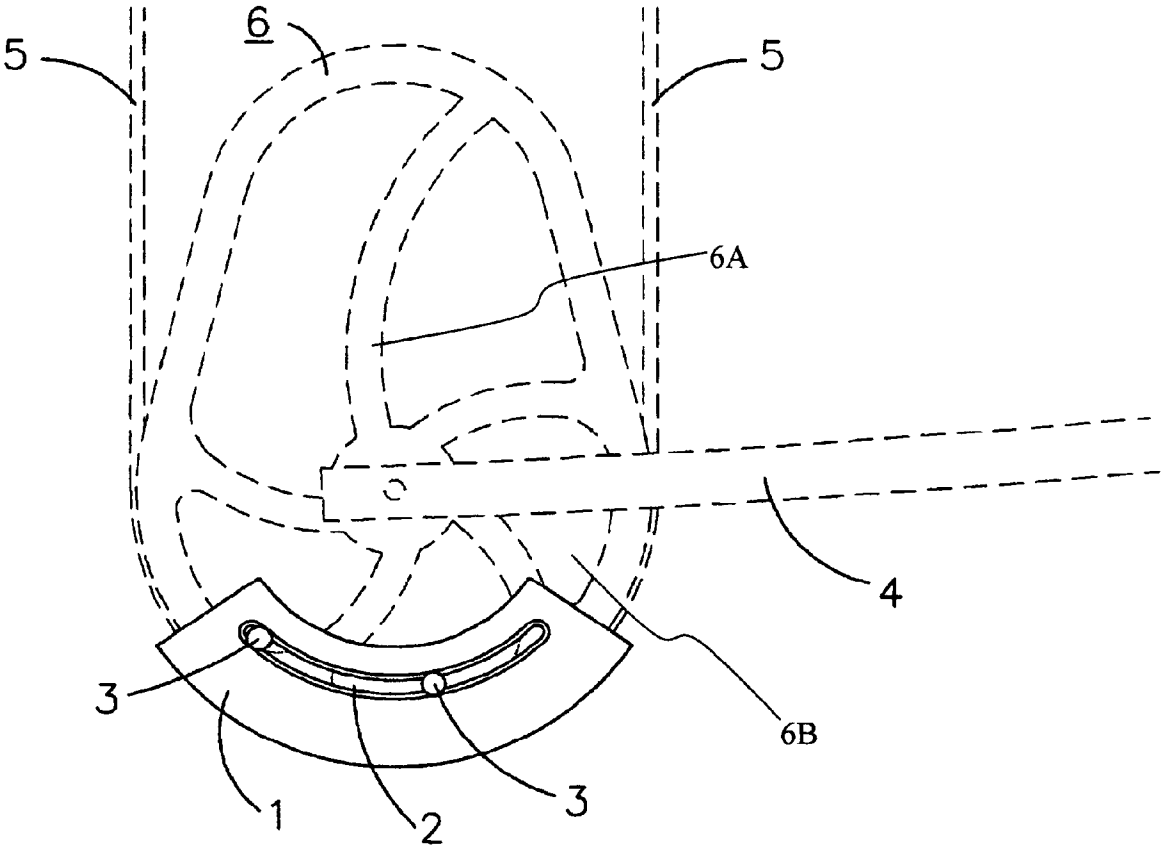
FIG. 3 is a side view showing CAM BLADE installed on a compound bow's elliptically ovid shape cam module.

In an alternate embodiment, viewing FIG. 3, side view showing 1 cam blade mounted onto 6 cam module. Many types of 6 cam modules exist therefore the 2 T-Slot is used to avoid the many different configurations of cam spokes, various outside diameters, elliptically ovidly shaped 6 cams, wheels, pulleys etc. By using the 2 T-Slot, said 3 T-Slot fasteners can be placed in a wide array of positions.

Figure 4:
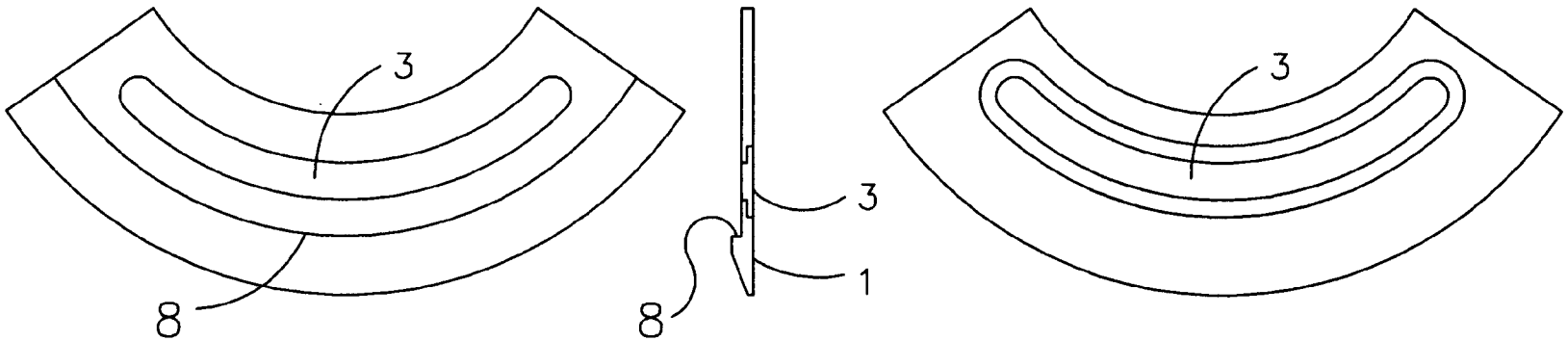
FIG. 4 is an inside view, end view and outside view of CAM BLADE.

FIG. 4 is an inside view, end view and outside view included for clarity. Additionally, said 1 cam blade has an interior 8 Cam Blade lip which rest upon the outer most edge of said 6 cam adjacent to 5 Power and buss cable. With the 8 cam blade lip, said 3 T-slot fastener and 7 fastener, said 1 Cam Blade is prohibited from moving radially inward or outward.

Such a structural configuration provides the unexpected and unpredictable advantage of rigidity while also providing protection from damage to such as but not limited to, an archer's elliptically ovidly shaped 6 cam module and associated 5 power and buss cable without interfering with either said module movement, said power and buss cable nor said take up track of 6 cam module.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention. In particular, with respect to the above description, it is to be realized that the optimum dimensional relationships for the parts of the non-limiting exemplary embodiments may include variations in size, materials, shape, form, function and manner of operation.

What is claimed as new and what is desired to secure by Letters Patent of the United States is:

1. A sweeping elliptically ovidly convex shaped CAM BLADE apparatus mounted on an archer's bow cam module for protecting an elliptically ovidly shaped bow cam module, associated power and buss cable and contact point on the take-up track of the cam module without interfering with either said module movement, said power and buss cable nor said take up track of cam module comprising:

an apparatus situated onto an archery bow cam module, beginning at or near the underside of bow stave and sweeps convexly about an center point proximate center bow cam module and said convex sweep terminates away from said bow stave at a point on cam module that is appropriate to provide damage and abrasive protection to cam module and power and buss cable;

wherein fastening devices extend through opening(s) in or between radial support(s) for said cam module; and wherein said apparatus has symmetrical plates sandwiching the bow cam module.

2. The apparatus of claim 1, wherein said symmetrical plates can be rotated about the center point of said cam module to a variety of positions; and wherein T-Slot allows fastening devices to avoid radial support(s) for said cam module.

3. The apparatus of claim 1, wherein said cam blade is shaped in an elliptical ovid shape and closely parallels said cam module; and wherein cam blade is rotatable with said cam module.

4. The apparatus of claim 1, wherein said cam blade has inward protruding lip from which cam blade can hang on the perimeter edge of a cam module; and said protruding lip does not allow inward radial movement.

5. The apparatus of claim 1, wherein said fastening devices do not allow for outward radial movement.

* * * * *